US009290968B2

(12) United States Patent
Beaudoin

(10) Patent No.: US 9,290,968 B2
(45) Date of Patent: Mar. 22, 2016

(54) LOCKING MECHANISM FOR A COVER

(71) Applicant: CANADA PIPE COMPANY ULC, Hamilton (CA)

(72) Inventor: Pierre-Laurent Beaudoin, Lévis (CA)

(73) Assignee: CANADA PIPE COMPANY ULC, Hamilton (CA)

( * ) Notice: Subject to any disclaimer, the term of this patent is extended or adjusted under 35 U.S.C. 154(b) by 211 days.

(21) Appl. No.: 14/109,382

(22) Filed: Dec. 17, 2013

(65) Prior Publication Data

US 2014/0166561 A1 Jun. 19, 2014

Related U.S. Application Data

(60) Provisional application No. 61/738,890, filed on Dec. 18, 2012.

(51) Int. Cl.

| | |
|---|---|
| ***E03F 5/06*** | (2006.01) |
| ***E05B 65/00*** | (2006.01) |
| ***E02D 29/14*** | (2006.01) |
| *E03F 5/04* | (2006.01) |

(52) U.S. Cl.

CPC ..... *E05B 65/006* (2013.01); *E02D 29/1427* (2013.01); *E03F 5/06* (2013.01); *E03F 5/0401* (2013.01); *E03F 2005/063* (2013.01); *E03F 2005/065* (2013.01); *Y10T 292/323* (2015.04)

(58) Field of Classification Search

CPC ..... E03F 5/0401; E03F 5/06; E03F 2005/063; E03F 2005/065; E02D 29/1427

USPC ..... 210/163, 164; 404/2, 4, 25; 49/463, 465

See application file for complete search history.

(56) References Cited

U.S. PATENT DOCUMENTS

| | | | |
|---|---|---|---|
| 490,301 | A | 1/1893 | Munson |
| 838,601 | A | 12/1906 | Willms |
| 1,460,733 | A | 7/1923 | Rigby |
| 1,491,314 | A | 4/1924 | Rigby |

(Continued)

FOREIGN PATENT DOCUMENTS

| | | |
|---|---|---|
| CA | 1186871 | 5/1985 |
| CA | 1189294 | 6/1985 |

(Continued)

OTHER PUBLICATIONS

Industries Fortier Ltée, "Catch Basin", datasheet, 1 page, publicly available at least as of Dec. 17, 2012, Canada.

(Continued)

*Primary Examiner* — Christopher Upton

(74) *Attorney, Agent, or Firm* — Fasken Martineau Dumoulin LLP

(57) ABSTRACT

A locking mechanism for a cover having at least a portion able to undergo elastic deformation and including at least one opening disposed at least partially in the at least portion of the cover able to undergo elastic deformation is provided. The locking mechanism includes at least one blocker movable between an open position where the at least one blocker is disengaged from the at least one opening, and a locked position where the at least one blocker is engaged in the at least one opening. In the locked position, the at least one blocker prevents at least partially elastic deformation of the at least portion of the cover. A cover and locking mechanism assembly is also provided.

11 Claims, 5 Drawing Sheets

(56) References Cited

U.S. PATENT DOCUMENTS

| | | | | |
|---|---|---|---|---|
| 1,763,174 | A | 6/1930 | Morris | |
| 1,858,268 | A | 5/1932 | Fleming | |
| 2,701,027 | A | 2/1955 | Scoville | |
| 3,304,685 | A | 2/1967 | Whetstone | |
| 3,838,706 | A | 10/1974 | Klenk et al. | |
| D244,854 | S | 6/1977 | Salamone | |
| 4,126,404 | A | 11/1978 | Ferns | |
| 4,279,541 | A | 7/1981 | Bruhn et al. | |
| D267,268 | S | 12/1982 | Johnson | |
| D270,292 | S | 8/1983 | Johnson | |
| 4,422,994 | A | 12/1983 | Ditcher | |
| D280,126 | S | 8/1985 | Provan et al. | |
| 4,536,103 | A | 8/1985 | Prescott | |
| 4,565,347 | A | 1/1986 | Ditcher | |
| 4,591,290 | A | 5/1986 | Prescott | |
| 4,685,650 | A | 8/1987 | Ditcher | |
| 4,737,220 | A | 4/1988 | Ditcher et al. | |
| 4,801,417 | A | 1/1989 | Ditcher | |
| 4,909,660 | A * | 3/1990 | Ferns | E03F 5/06 404/4 |
| 4,941,643 | A | 7/1990 | Ditcher | |
| 4,952,094 | A | 8/1990 | Spiess et al. | |
| 5,072,846 | A | 12/1991 | Portwood | |
| 5,095,667 | A | 3/1992 | Ryan et al. | |
| D337,296 | S | 7/1993 | Steinke et al. | |
| 5,279,007 | A | 1/1994 | Kolada | |
| 5,299,884 | A | 4/1994 | Westhoff et al. | |
| 5,340,232 | A * | 8/1994 | Spiess | E03F 5/06 404/25 |
| D352,573 | S | 11/1994 | Sampson et al. | |
| 5,386,669 | A | 2/1995 | Almeida | |
| D369,404 | S | 4/1996 | Vestal | |
| 5,634,739 | A | 6/1997 | Armstrong | |
| 5,849,181 | A | 12/1998 | Monteith | |
| 6,045,691 | A | 4/2000 | McDermott | |
| 6,068,765 | A | 5/2000 | Monteith | |
| 6,109,824 | A | 8/2000 | Annes | |
| 6,270,662 | B1 | 8/2001 | Gibson et al. | |
| 6,385,913 | B1 | 5/2002 | Ahn | |
| 6,537,446 | B1 | 3/2003 | Sanguinetti | |
| 6,722,813 | B2 * | 4/2004 | Hauer | E02D 29/1427 404/25 |
| 6,869,525 | B1 | 3/2005 | Happel | |
| 6,986,226 | B2 | 1/2006 | Banks | |
| 7,033,489 | B2 * | 4/2006 | Thompson | E03F 5/06 210/164 |
| 7,040,838 | B2 | 5/2006 | Allard et al. | |
| D596,273 | S | 7/2009 | Porter | |
| D630,714 | S | 1/2011 | Dukes | |
| D658,440 | S | 5/2012 | Funnell, II et al. | |
| 8,182,171 | B2 | 5/2012 | Poulsen | |
| 8,292,541 | B2 | 10/2012 | Akkala | |
| 8,591,729 | B2 | 11/2013 | Alqanee | |
| D699,820 | S | 2/2014 | Beaudoin | |
| D699,821 | S | 2/2014 | Beaudoin | |
| D722,366 | S | 2/2015 | Beaudoin | |
| D722,678 | S | 2/2015 | Beaudoin | |
| D725,238 | S | 3/2015 | Beaudoin | |
| 9,127,447 | B2 * | 9/2015 | Beaudoin | E03F 5/0401 |
| 2002/0071722 | A1 | 6/2002 | Allard | |
| 2003/0046877 | A1 | 3/2003 | Banks | |
| 2004/0112811 | A1 | 6/2004 | Lindemulder | |
| 2005/0230295 | A1 * | 10/2005 | Monneret | E03F 5/06 210/164 |
| 2006/0011527 | A1 | 1/2006 | McDermott et al. | |
| 2006/0159515 | A1 * | 7/2006 | Messerschimidt | E03F 5/06 404/4 |
| 2006/0171778 | A1 * | 8/2006 | Fuchs | E03F 5/06 404/2 |
| 2006/0230688 | A1 | 10/2006 | Carr | |
| 2008/0179229 | A1 | 7/2008 | Dorsey | |
| 2010/0124458 | A1 | 5/2010 | Munro | |
| 2011/0150570 | A1 | 6/2011 | Pickavance et al. | |
| 2013/0186811 | A1 | 7/2013 | Kaiser | |
| 2014/0255098 | A1 * | 9/2014 | Beaudoin | E03F 5/06 405/36 |

FOREIGN PATENT DOCUMENTS

| | | | |
|---|---|---|---|
| CA | 1204317 | | 5/1986 |
| CA | 1208025 | | 7/1986 |
| CA | 1245832 | | 12/1988 |
| CA | 1320071 | | 7/1993 |
| CA | 2153008 | A1 | 1/1996 |
| CA | 2220243 | A1 | 9/1997 |
| CA | 2206338 | A1 | 11/1998 |
| DE | 1002249 | | 2/1957 |
| DE | 6906871 | | 6/1969 |
| DE | 1905728 | | 8/1970 |
| DE | 4437518 | A1 | 4/1996 |
| DE | 29707603 | | 8/1997 |
| EP | 0337110 | A1 | 10/1989 |
| EP | 0668409 | A1 | 8/1995 |
| EP | 0694654 | A1 | 1/1996 |
| EP | 0811732 | A1 | 12/1997 |
| EP | 1254991 | A2 | 11/2002 |
| FR | 2200415 | | 4/1974 |
| FR | 2384904 | | 10/1978 |
| FR | 2740789 | A1 | 5/1997 |
| FR | 2803859 | A1 | 7/2001 |
| FR | 2920163 | A1 | 2/2009 |
| GB | 2205601 | | 12/1988 |
| WO | 96/01929 | A1 | 1/1996 |
| WO | 97/26415 | A1 | 7/1997 |
| WO | 97/49872 | A1 | 12/1997 |
| WO | 01/83892 | A1 | 11/2001 |

OTHER PUBLICATIONS

Groupe Lecuyer, "Catch basin for rectangular cast iron grate of 455mm×915mm", datasheet, 1 page, available on the internet at http://www.lecuyerbeton.com/en/products/storm-and-sanitaiy-products/catch-basins-and-manholes-catch-basins/regards-puisards at least as of Jan. 9, 2009, Canada.

Béton Provincial, "Reinforced concrete catch basins", datasheet, 1 page, available on the internet at http://www.betonprovincial.com/public/files/pdf/en/manuel-techniques/REINFORCED-CONCRETE-CATCH-BASINS.pdf at least as of Apr. 7, 2009, Canada.

Gully Grating, Kerb Gratings, Products and Services, indiamart.com, searched Oct. 7, 2014, http://www.indiamart.com/jpkmetallics/kerb-gratings.html#gully-grating.

* cited by examiner

LOCKING MECHANISM FOR A COVER

TECHNICAL FIELD

The invention relates to covers and more particularly for a locking mechanism for the cover.

BACKGROUND OF THE ART

During road construction, storm drains (also known as catch basins) and sewer inlets are disposed at various points along the road to evacuate excess water and/or debris that may accumulate. Such accumulation can occur for example during rainfall.

The storm drains (or catch basins) are connected to a sewerage system which is a network of pipes, pumps, and force mains for the collection of wastewater, or sewage, from the community. Typically, storm drains use a separate and distinct sewerage network from sanitary sewer systems for human waste. Sometimes a combined system provides only one network for all types of sewage and excess water or debris.

In order to evacuate the excess water and debris toward the sewerage system, the storm drain includes an inlet disposed on the road surface. Two main types of inlets exist: the side inlet and the grated inlet. The sewerage typically ends in an outlet for the water which is a single large exit at the point of discharge. The separation of storm sewers from sanitary sewers helps to prevent sewage treatment plants becoming overwhelmed by infiltration/inflow during a rainstorm, which can result in untreated sewage being discharged into the environment.

The grated inlets prevent pedestrians, vehicles and large objects from falling into the storm drain. The design of the grate bars facilitates a flow of water towards the inside of the drain. Storm drains provided in streets and parking areas must be strong enough to support the weight of the vehicles. Some of the heavier sediment and small objects or debris may enter the grated inlet and settle in the catchbasin below the inlet. A frame is provided for the catchbasin or catch pit and the grate covers the open top of the frame of the catchbasin.

The grate is usually made of a ductile iron material and is simply fit flush with the open top of the frame. The grate has to be able to sustain different types of loads and different weather conditions. When a road is deviated from its usual path, the frame and grate may experience a traffic greater than it is normally exposed to. In some cases, the traffic forces the grate out of the frame, leaving the conduit or pipe head exposed, and thereby revealing a hole in the road. Having the conduit head exposed can become problematic for the road users.

In order to prevent the grate from detaching from the frame, some have solidified the grate to the frame. While this may allow the grate to stay connected to the frame, it prevents later access to the conduit for maintenance of the sewerage system.

Others have installed weights hanging downward from the grate in the conduit to weight the grate down toward the frame. However, these weights make it difficult for the grate to be removed during maintenance.

SUMMARY

Accordingly, there is provided a locking mechanism for a cover. The cover has at least a portion able to undergo elastic deformation. The cover includes at least one opening disposed at least partially in the at least portion of the cover. The locking mechanism includes at least one blocker movable between an open position where the at least one blocker is disengaged from the at least one opening, and a locked position where the at least one blocker is engaged in the at least one opening. In the locked position, the at least one blocker prevents at least partially elastic deformation of the at least portion of the cover.

In one embodiment, the at least one blocker is at least one latch pivotally connected to the cover.

In one embodiment, in the open position, the at least one latch is adapted to be at an angle with respect to the cover, and in the locked position, the at least one latch is adapted to be aligned with the cover.

In one embodiment, a thickness of the at least one blocker corresponds to a width of the at least one opening.

There is also provided a cover and locking mechanism assembly comprising a cover including at least a portion able to undergo elastic deformation. The cover includes at least one opening disposed at least partially in the at least portion of the cover. A locking mechanism includes at least one blocker movable between an open position where the at least one blocker is disengaged from the at least one opening, and a locked position where the at least one blocker is engaged in the at least one opening. In the locked position, the at least one blocker prevents at least partially elastic deformation of the at least portion of the cover.

In one embodiment, the cover is a grate. The grate includes a frame and a plurality of crisscrossly arranged bars extending within the frame.

In one embodiment, at least one of the at least one blocker and the cover is made at least partially of ductile iron.

In one embodiment, the at least one blocker includes at least one latch pivotally connected to the cover.

In one embodiment, the cover defines a longitudinal plane. In the open position, the at least one latch is at an angle with respect to the longitudinal plane, and in the locked position, the at least one latch is contained in the longitudinal plane.

In one embodiment, a thickness of the at least one blocker corresponds to a width of the at least one opening.

In one embodiment, the at least one opening is disposed between two adjacent bars of the plurality of crisscrossly arranged bars.

In one embodiment, the at least portion able to undergo elastic deformation is at least one first portion. The at least one opening is at least one first opening. The grate includes at least one second portion able to undergo elastic deformation. The grate includes at least one second opening disposed at least partially within the at least one second portion.

In one embodiment, the at least second portion able to undergo elastic deformation and the at least one second opening are disposed within the frame.

In one embodiment, the at least second portion able to undergo elastic deformation and the at least one second opening are disposed within the plurality of crisscrossly arranged bars.

In one embodiment, the plurality of crisscrossly arranged bars forms a chevron pattern.

Embodiments of the present can have at least one of the above-mentioned aspects, but do not necessarily have all of them.

Additional and/or alternative features, aspects, and advantages of embodiments of the present will become apparent from the following description, the accompanying drawings, and the appended claims.

BRIEF DESCRIPTION OF THE DRAWINGS

Having thus generally described the nature of the invention, reference will now be made to the accompanying drawings, showing, by way of illustration, embodiments, aspects and features thereof and in which.

It will be noted that throughout the appended drawings, like features are identified by like reference numerals.

DETAILED DESCRIPTION

Figure 1:
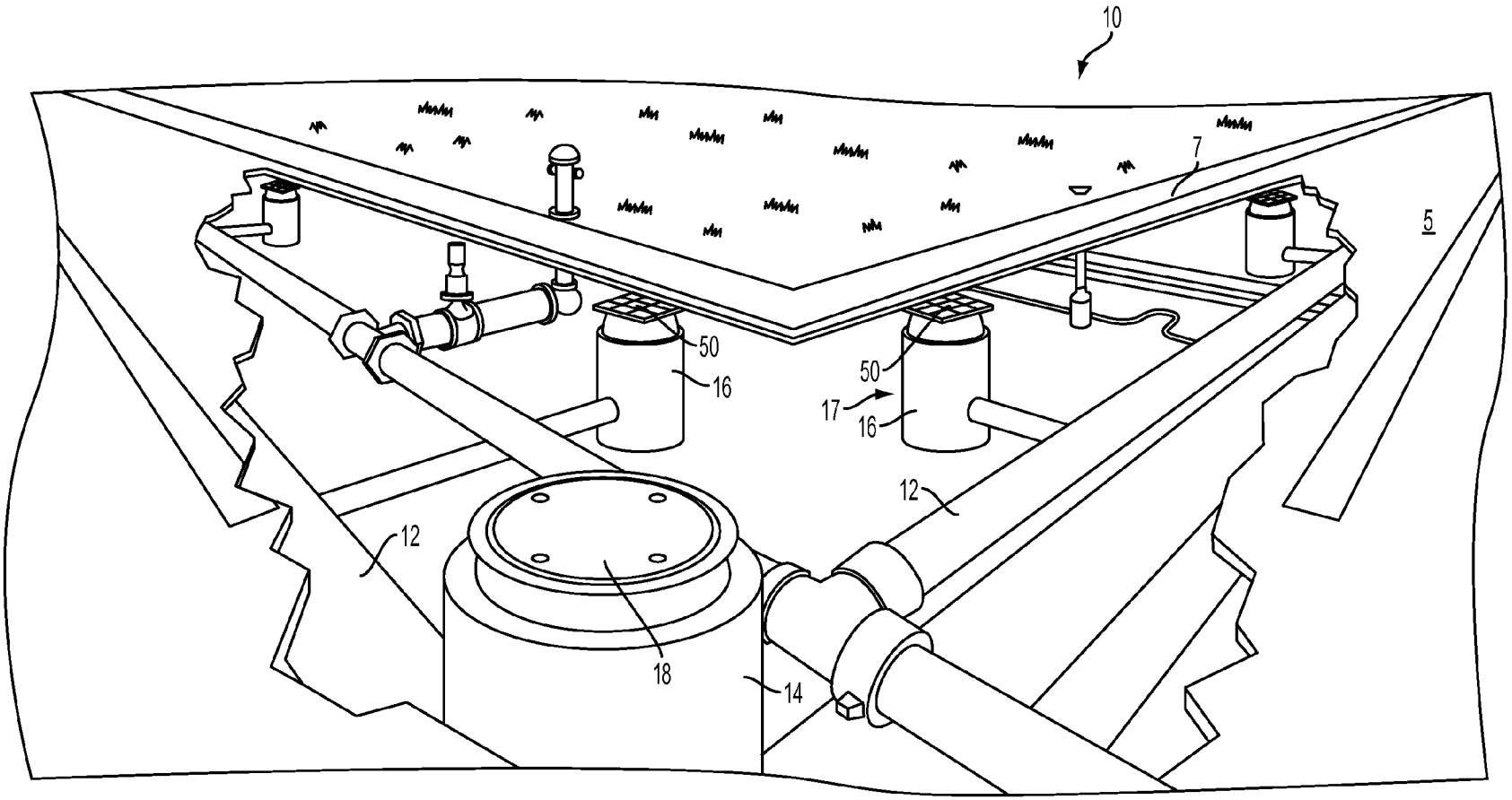
FIG. 1 is an illustration of a road partially cut out to reveal a sewerage system including a plurality of manholes and drains with their respective drains.

Referring to FIG. 1, a sewerage system 10 includes a plurality of interconnected pipes or conduits 12, disposed underground vertically below a concrete or paved road 5. A plurality of manholes 14 and drains 16 with inlets connect the sewerage system 10 to the road 5. As illustrated in FIG. 1, the drains 16 are located on lateral sides of the road 5 near sidewalks or curbs 7, while the plurality of manholes 14 are found toward a middle of the road 5. The plurality of manholes 14 have closed covers 18 which do not allow the passage of debris, while the drains 16 have open grated covers 50 which allow passage of excess water and small debris. The grates 50 (shown in detail in FIG. 3 and FIG. 6) will be described below. It is contemplated that one, some or all of the plurality of manholes 14 could be provided with grated covers 50 instead of closed covers 18.

A catch pit 17 is located under the inlet 50 of the drain 16 to receive the debris.

Figure 2:
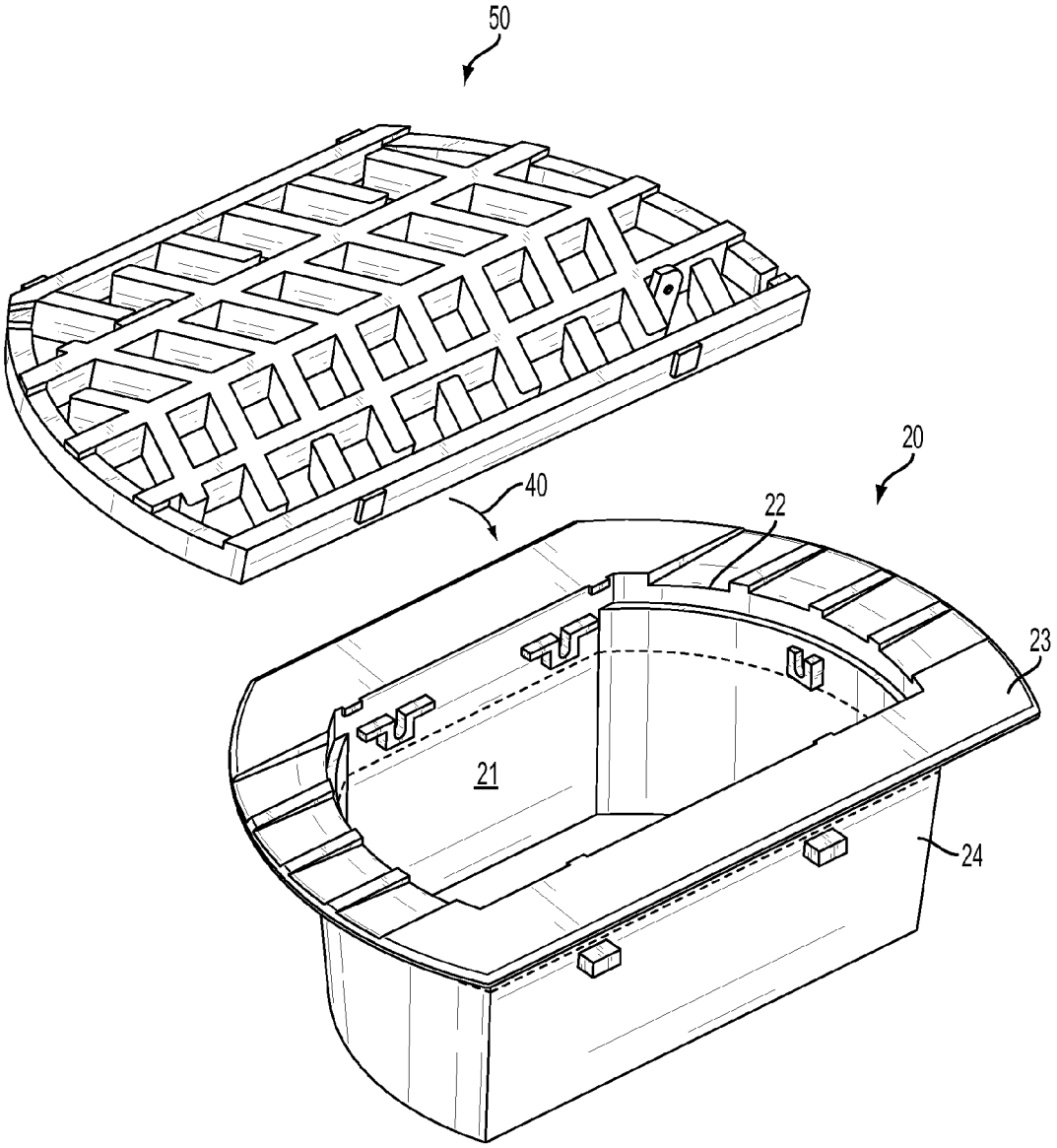
FIG. 2 is a perspective exploded view of a frame and grate for one of the drains of FIG. 1.

Turning now to FIG. 2, each of the drains 16 includes a frame 20 onto which is received the grate 50 (as indicated by arrow 40). The frame 20 has an open top 21 defined by a grate receiving contour 22. The grate receiving contour 22 has a shape mating the outer shape of the grate 50. The frame 20 includes walls 24 extending downwardly from the grate receiving contour 22. The walls 24 are to be inserted into the catch pit 17. Side flanges 23 extend laterally from the grate receiving contour 22. The side flanges 23 help prevent water infiltration between the frame 20 and the concrete or asphalt pavement. The grooves 22 help water enter the catch basin by gravity.

Frame 20 shown herein is an autostable frame used on concrete roads, but it is contemplated that frame 20 could be used for other purposes. For example, frame 20 could be sealed directly to road 5. Any frame having a contour with a shape mating the one of grate 50 could be used. As such, frame 20 could have a shape different from the one shown herein. For example, side flanges 23 and/or downwardly extending walls 24 could be omitted. The frame 20 may be a unitary piece or may be formed around the grate 50 a posteriori, such as by pouring concrete to surround grate 50 is in place. The frame 20 is made of ductile iron. It is contemplated that the frame 20 could be made of a material other than ductile iron. For example, the frame 20 could be made of metal, and/or a polymer and/or rubber and/or concrete, and/or any other material that would have some degree of flexibility.

Figure 3:
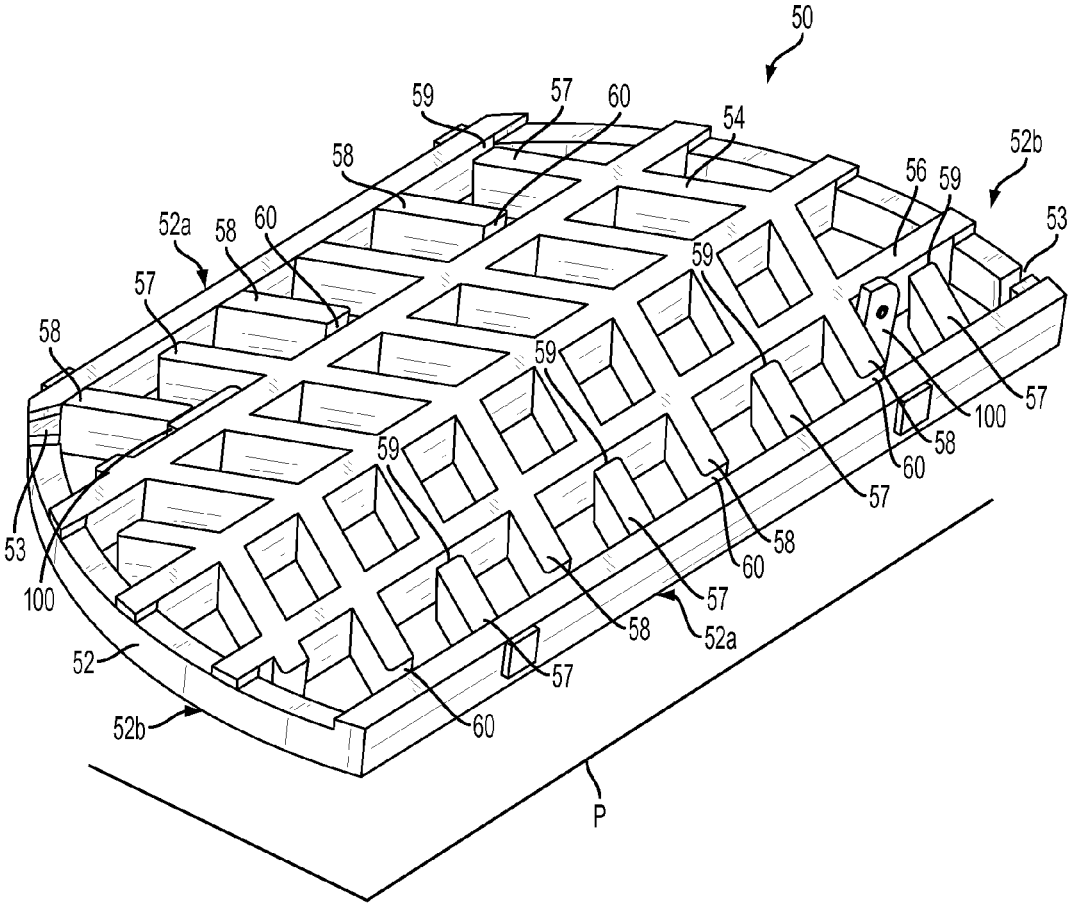
FIG. 3 is a perspective view of the grate of FIG. 2.
Figure 4:
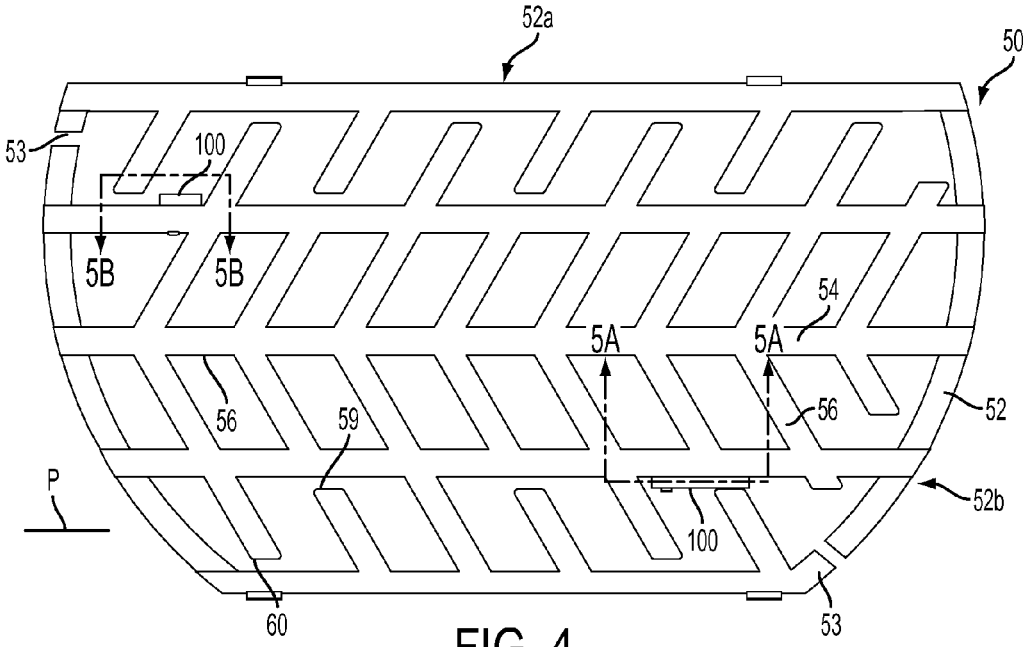
FIG. 4 is a top plan view of the grate of FIG. 3 showing two latches being part of a locking mechanism for the grate of FIG. 2.

Turning now to FIG. 3, the grate 50 includes a grate frame 52 which has a shape matching a shape of the grate receiving contour 22 of the frame 20. The grate frame 52 includes two straight longitudinal sides 52*a* and two curved lateral sides 52*b*. As mentioned above, the grate frame 52 may have a shape different from the one described herein depending on the shape of the grate receiving contour 22 of the frame 20. This alternative shape could, for example, be circular or rectangular. The grate frame 52 includes two spaces (or openings) 53 disposed on the lateral sides 52*a* of the grate frame 52. As will be described below, the spaces 53 allow elastic deformation of the grate 50. It is contemplated that the grate frame 52 could have only one or more than two spaces 53. It is also contemplated that some or all of the spaces 53 could be disposed on the longitudinal sides 52*a* of the grate frame 52.

The grate 50 includes a plurality of bars 54 that together form a substantially crisscrossed arrangement. The substantially crisscrossed arrangement is achieved by a plurality of longitudinal bars 56 intersecting with a plurality of sideway bars 58. The sideway bars 58 and the longitudinal bars 56 intersect at an angle of about 45 degrees so as to form a chevron pattern. Although the arrangement of the bars 54 is shown as forming chevrons in FIG. 3, it is contemplated that the bars 54 could have other arrangements. Such arrangements could include, for example, perpendicularly crossing bars. In another example, the pattern is not geometrical.

The longitudinal bars 56 are fixedly connected to the grate frame 52, while some of the sideway bars 58 are spaced from the grate frame 52 by spaces (or openings) 60. It is contemplated that some of the longitudinal bars 56 could be spaced from the grate frame 52 and/or all of the sideway bars 58 could be fixedly connected to the grate frame 52. Similarly to the spaces 53, the spaces 60 allow elastic deformation of the grate 50. The spaces 60 are shown herein to be located between the grate frame 52 and some of the sideway bars 58, but it is contemplated that the spaces 60 could be located on a sideway bar 58 and/or on a longitudinal bar 56. Some of the sideway bars 58, indicated by reference numeral 57, are fixedly connected to the grate frame 52 and spaced from the other sideway bars 58 by spaces (or openings) 59. Similarly to the spaces 53 and 60, the spaces 59 allow elastic deformation of the grate 50. It is contemplated that some or all of the sideway bars 57 which are fixedly connected to the grate frame 52 could be fixedly connected the other sideway bars 58.

The grate 50 is made of ductile iron which allows some elastic deformation. As such, the grate frame 52 can be modified to fit over the grate receiving contour 22 of the frame 20 should the grate receiving contour 22, as it is the case in this embodiment, have a perimeter slightly smaller than a perimeter of the grate receiving contour 22. In another embodiment, the grate receiving contour could have a perimeter slightly different than a perimeter of the grate receiving contour. By 'slightly', one should understand within the elastic deformation range of the grate. The elastic deformation is used to tighten the grate 50 against the frame 20 once the grate 50 is in place onto the frame 20. As such, the grate 50 is made of a material that allows some elastic deformation but is not so elastic that the grate 50 could come off the frame 20 when in use. When a user wants to place the grate 50 onto the frame 20, he/she pushes it against the frame 20, thereby deforming slightly the grate 50 in a longitudinal plane P using the spaces 53, 59 and 60, and allowing the grate 50 to fit the grate receiving contour 22. Once in place, the grate 50 being elastically deformable, the grate 50 has a tendency to expand back to its original shape which exerts a force against the grate receiving contour 22 of the frame 20, thereby providing some retention of the grate 50 to the frame 20. In order to provide an additional amount of retention, a locking mechanism 100 is used.

Figure 5A:
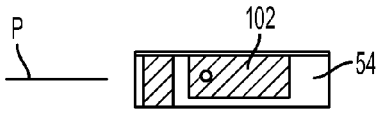
FIG. 5A is a view along line A-A of FIG. 4 showing one of the latches of the locking mechanism in a locked position.
Figure 5B:
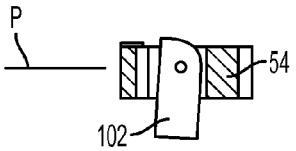
FIG. 5B is a view along line B-B of FIG. 4 showing one of the latches of the locking mechanism in an open position.

Turning to FIGS. 5A and 5B, the locking mechanism 100 includes two blockers in the shape of latches 102 pivotally connected to the grate 50. In the embodiment shown herein, the latches 102 are disposed in a vicinity of respective spaces 59 or 60. The latches 102 have a thickness of about a width of their associated spaces 59, 60. The latches 102 are movable between an open position (shown in FIG. 5B) where the latches 102 are not engaged in the respective spaces 59 or 60, and a locked position (shown in FIG. 5A) where the latches 102 are engaged in their associated spaces 59 or 60. In the open position, the latches 102 are disposed at an angle with respect to the longitudinal plane P, whereas in the locked position, the latches 102 are contained in the longitudinal plane P. It is contemplated that the locking mechanism 100 could include only one or more than two latches 102. It is also contemplated that the latches 102 could be connected to the grate 50 in a way other than by a pivot. For example, the latches 102 could be removable blockers connected to the grate 50 and be selectively inserted in the spaces 59 and 60. It is also contemplated that the latches 102 could only act on spaces 59 or only on spaces 60. The locking mechanism 100 may be embodied by types of blockers other than the ones described herein, as long as the blockers prevent, at least partially, elastic deformation of the cover they act on when in the locked position.

The grate 50 is typically installed on the frame 20 as described above with the latches 102 in the open position so as to allow elastic deformation of the grate 50 during its installation on to the frame 20. To lock the grate 50, the user pivots the latches 102 from the open position to the locked position. The user may have to use tools (e.g. hammer) to force the latches 102 in engagement with the spaces 59, 60. Once in the locked position, elastic deformation of the grate 50 is restrained, since the presence of the latches 102 in the spaces 59, 60, when in the locked position, induces an outward force directed toward the grate receiving contour 22 of the frame 20.

Figure 6A:
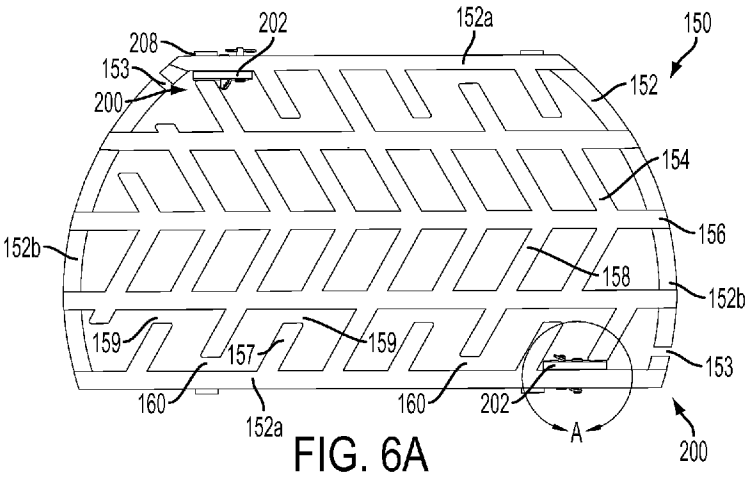
FIG. 6A is a top plan view of an alternative embodiment for the grate with two latches being part of an alternative locking mechanism.
Figure 6B:
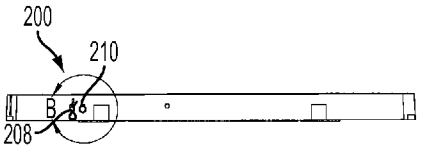
FIG. 6B is a side view of the grate of FIG. 6A.

Turning now to FIG. 6A, an alternative embodiment for the grate 50 is shown. Grate 150 includes a grate frame 152 which has a shape matching a shape of the grate receiving contour 22 of the frame 20. The grate frame 152 includes two straight longitudinal sides 152*a* and two curved lateral sides 152*b*. The grate frame 152 includes two spaces (or openings) 153 disposed on the lateral sides 152*a* of the grate frame 152. The grate 150 includes a plurality of bars 154 that together form a substantially crisscrossed arrangement. The substantially crisscrossed arrangement is achieved by a plurality of longitudinal bars 156 intersecting with a plurality of sideway bars 158. The sideway bars 158 and the longitudinal bars 156 intersect at an angle of about 45 degrees so as to form a chevron pattern. The longitudinal bars 156 are fixedly connected to the grate frame 152, while some of the sideway bars 158 are spaced from the grate frame 152 by spaces (or openings) 160. Some of the sideway bars 158, indicated by reference numeral 157, are fixedly connected to the grate frame 152 and spaced from the other sideway bars 158 by spaces (or openings) 159. FIG. 6B shows a side view of the grate 50.

Locking mechanism 200 is used to secure grate 150 in frame 20. The locking mechanism 200 includes two blockers 202. The blockers 202 are disposed in a vicinity of respective spaces 159 or 160. As shown in FIG. 7A, the blockers 202 are selectively inserted in their associated spaces 159 or 160 to lock the grate. The blockers 202 can be made of ductile iron material. The blockers 202 can be secured to the grate frame 152 by fasteners 204 inserted in a respective aperture 206 of the grate frame 152 and hole 207 of the blocker 202. The fasteners 204 can take on a plurality of forms, such as screws, pins, nails, etc. They can be threaded and/or tapered. If pins are to be used as fasteners 204, taper pins, dowel pins, roll (spring) pins, hitch pins, clevis pins, etc. can be used.

Figure 7B:
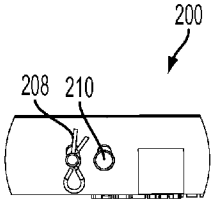
FIG. 7B is a view of detail B of FIG. 6B.
Figure 7A:
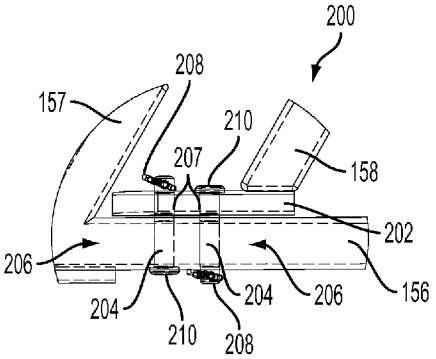
FIG. 7A is a view of detail A of FIG. 6A.

In the example embodiment of FIGS. 6 and 7, blocker 202 is inserted in the appropriate space 160 and apertures 206 are aligned with holes 207. A clevis pin 210 is inserted in each set of aligned pin aperture 206 and pin hole 207 and thereby secures blocker 202 to grate frame 152 at two locations. Hitch pins 208 are inserted in clevis pins 210 to secure clevis pins 210 in pin apertures 206 and pin holes 207 and thereby to secure blocker 202 to grate frame 152.

The frame 20 and the sewerage system 10 are only one possible embodiment where the locking mechanisms 100 or 200 could be used on a grate. The frame 20, the sewerage system 10 and the grate 50 or 150 are used herein to describe a context in which the locking mechanism 100 or 200 could be used, but it is understood that the locking mechanism 100 or 200 could be used in a context widely different from the one described herein, as long as the locking mechanism 100 or 200 performs substantially in the same way as described herein. For example, the grate 50 or 150 could be a grate used in a ventilation system as opposed to a sewage system. Also, the locking mechanism 100 or 200 may be used on covers other than a grate as long as the cover has at least one opening disposed in a portion of the cover that is elastically deformable. For example, the locking mechanism 100 or 200 may be used on a cover that has only a portion of it being a grate.

Modifications and improvements to the above-described embodiments of the present may become apparent to those skilled in the art. The foregoing description is intended to be exemplary rather than limiting. The scope of the present is therefore intended to be limited solely by the scope of the appended claims.

I claim:

1. A cover and locking mechanism assembly comprising:

a cover including:

at least a portion able to undergo elastic deformation, the cover including at least one opening disposed at least partially in said at least portion of the cover; and a locking mechanism including:

at least one blocker movable between an open position where the at least one blocker is disengaged from the at least one opening, and a locked position where the at least one blocker is engaged in the at least one opening, in the locked position the at least one blocker preventing at least partially elastic deformation of the at least portion of the cover.

2. The cover and locking mechanism assembly of claim 1, wherein the cover is a grate, the grate includes a frame and a plurality of crisscrossly arranged bars extending within the frame.

3. The cover and locking mechanism assembly of claim 2, wherein the at least one opening is disposed between two adjacent bars of the plurality of crisscrossly arranged bars.

4. The cover and locking mechanism assembly of claim 2, the plurality of crisscrossly arranged bars forms a chevron pattern.

5. The cover and locking mechanism assembly of claim 2, wherein the at least portion able to undergo elastic deformation is at least one first portion;

the at least one opening is at least one first opening;

the cover includes at least one second portion able to undergo elastic deformation; and the cover includes at least one second opening disposed at least partially within the at least one second portion.

6. The cover and locking mechanism assembly of claim 5, wherein the at least second portion able to undergo elastic deformation and the at least one second opening are disposed within the frame.

7. The cover and locking mechanism assembly of claim 5, wherein the at least second portion able to undergo elastic deformation and the at least one second opening are disposed within the plurality of crisscrossly arranged bars.

8. The cover and locking mechanism assembly of claim 1, wherein at least one of the at least one blocker and the cover is made at least partially of ductile iron.

9. The cover and locking mechanism assembly of claim 1, wherein the at least one blocker includes at least one latch pivotally connected to the cover.

10. The cover and locking mechanism assembly of claim 9, wherein the cover defines a longitudinal plane, in the open position, the at least one latch is at an angle with respect to the longitudinal plane, and in the locked position, the at least one latch is contained in the longitudinal plane.

11. The cover and locking mechanism assembly of claim 1, wherein a thickness of the at least one blocker corresponds to a width of the at least one opening.

* * * * *